US011078682B1

(12) United States Patent
diGirolamo et al.

(10) Patent No.: US 11,078,682 B1
(45) Date of Patent: Aug. 3, 2021

(54) CONNECTOR ASSEMBLY FOR ALLOWING RELATIVE MOVEMENT BETWEEN TWO BUILDING MEMBERS

(71) Applicant: The Steel Network, Inc., Durham, NC (US)

(72) Inventors: Edward R. diGirolamo, Raleigh, NC (US); Travis Everett Vap, Englewood, CO (US); Stephen James Bradford, Littleton, CO (US); Megan Marvel Washnieski, Rochester, MN (US); Brian Duane Rohnke, Lakewood, CO (US)

(73) Assignee: The Steel Network, Inc., Durham, NC (US)

( * ) Notice: Subject to any disclaimer, the term of this patent is extended or adjusted under 35 U.S.C. 154(b) by 0 days.

(21) Appl. No.: 15/847,626

(22) Filed: Dec. 19, 2017

Related U.S. Application Data

(60) Provisional application No. 62/436,262, filed on Dec. 19, 2016.

(51) Int. Cl.
*E04B 1/24* (2006.01)
*E04B 1/41* (2006.01)
(Continued)

(52) U.S. Cl.
CPC ..... *E04H 9/021* (2013.01); *E04B 1/2403* (2013.01); *E04B 1/41* (2013.01);
(Continued)

(58) Field of Classification Search
CPC ..... E04B 2001/2415; E04B 2001/2439; E04B 2001/405; E04B 2005/173; E04B 2005/322; E04B 1/41; E04B 1/2403; E04H 9/021
See application file for complete search history.

(56) References Cited

U.S. PATENT DOCUMENTS 1,400,007 A 12/1921 Sparks
1,691,784 A 11/1928 Pietzsch
(Continued)

FOREIGN PATENT DOCUMENTS

JP S 54-69651 6/1979

OTHER PUBLICATIONS

Office Action corresponding to U.S. Appl. No. 10,689,498 dated Oct. 4, 2005.
(Continued)

*Primary Examiner* — Andrew J Triggs
(74) *Attorney, Agent, or Firm* — Jenkins, Wilson, Taylor & Hunt, P.A.

(57) ABSTRACT

The present subject matter relates to systems, assemblies, and methods for connecting structural members together. A connector assembly includes an elongated track having a web, opposed edge portions that extend from a first surface of the web and that form a pair of slide channels, and one or more protrusions protruding from a second surface of the web opposing the first surface, the one or more protrusions being configured to connect to the first building member. A connecting member is adapted to connect to the second building member and includes a base that retains the connecting member to the channels but is movable within the channels along the track. In this configuration, when the connector assembly is connected between the first and second building members, the connecting member is movable in the track in response to relative movement between the first and second building members.

12 Claims, 12 Drawing Sheets

(51) Int. Cl.
*E04B 1/38* (2006.01)
*E04H 9/02* (2006.01)

(52) U.S. Cl.
CPC ..... *E04B 2001/2415* (2013.01); *E04B 2001/2439* (2013.01); *E04B 2001/405* (2013.01)

(56) References Cited

U.S. PATENT DOCUMENTS 1,729,935 A 10/1929 Froehlich
2,065,529 A 12/1936 Kehr et al.
2,365,478 A 12/1944 La Grotta
3,003,600 A 10/1961 MacKenzie
3,327,438 A 6/1967 Cooper
3,363,379 A * 1/1968 Curran ..... E04B 5/29 52/334
3,451,183 A 6/1969 Lespagnol et al.
3,490,797 A 1/1970 Platte
3,715,850 A 2/1973 Chambers
3,798,865 A 3/1974 Curtis
3,898,782 A 8/1975 Donato
4,148,454 A 4/1979 Carlson et al.
4,251,969 A 2/1981 Bains
4,261,593 A 4/1981 Yeager
4,285,173 A * 8/1981 Grearson ..... E04B 5/40 52/250
4,363,459 A 12/1982 Holzer
4,464,074 A 8/1984 Green et al.
4,527,372 A * 7/1985 Ryan ..... E04B 5/40 52/334
4,586,841 A 5/1986 Hunter
4,665,672 A 5/1987 Commins et al.
4,796,403 A 1/1989 Fulton et al.
4,949,929 A 8/1990 Kesselman et al.
4,973,102 A 11/1990 Bien
5,009,557 A 4/1991 Dessirier
5,027,494 A 7/1991 Martin
5,180,250 A 1/1993 Ferro
5,195,289 A 3/1993 Lalonde et al.
5,375,384 A 12/1994 Wolfson
5,467,570 A 11/1995 Leek
5,529,273 A 6/1996 Benthin
5,572,844 A 11/1996 Stackenwalt et al.
5,577,860 A 11/1996 Plank
5,664,392 A 9/1997 Mucha
5,671,580 A 9/1997 Chou
5,720,571 A 2/1998 Frobosilo et al.
5,794,395 A 8/1998 Reed
5,846,018 A 12/1998 Frobosilo et al.
5,876,006 A 3/1999 Sharp et al.
5,906,080 A 5/1999 diGirolamo et al.
5,937,605 A 8/1999 Wendt
6,058,668 A 5/2000 Herren
6,158,188 A 12/2000 Shahnazarian
6,199,929 B1 3/2001 Hansch
6,213,679 B1 4/2001 Frobosilo et al.
6,250,041 B1 6/2001 Seccombe
6,494,639 B1 12/2002 Friend
6,612,087 B2 9/2003 diGirolamo et al.
6,719,481 B2 4/2004 Hoffmann
6,880,302 B1 4/2005 Fontaine
6,941,712 B2 9/2005 Sukup et al.
7,104,024 B1 9/2006 diGirolamo et al.
7,389,620 B1 * 6/2008 McManus ..... E04B 5/23 52/326
7,503,150 B1 * 3/2009 diGirolamo ..... E04B 2/96 403/403
8,096,084 B2 * 1/2012 Studebaker ..... E04B 1/003 52/250
8,387,321 B2 * 3/2013 diGirolamo ..... E04B 2/58 52/241
8,713,877 B2 * 5/2014 Underwood ..... E01C 11/08 52/396.02
8,973,317 B2 * 3/2015 Larkin ..... E04B 1/7608 52/223.14
9,359,756 B2 * 6/2016 Hardy ..... E04B 1/2403
9,422,720 B2 * 8/2016 Shevlin ..... E04D 5/147
2005/0241084 A1 * 11/2005 Delis ..... E01D 19/065 14/73.5
2009/0188185 A1 * 7/2009 Studebaker ..... E04B 1/003 52/252
2012/0102862 A1 * 5/2012 Underwood ..... E01C 11/08 52/396.02
2014/0000206 A1 * 1/2014 Studebaker ..... F16B 5/0275 52/650.3
2014/0260018 A1 * 9/2014 Kalloo ..... E04C 5/0645 52/253
2014/0298745 A1 * 10/2014 Rechenmacher ..... E04B 1/161 52/425

OTHER PUBLICATIONS

Notice of Allowance corresponding to U.S. Appl. No. 10/689,498 dated May 3, 2006.
Office Action corresponding to U.S. Appl. No. 10/886,358 dated Nov. 14, 2006.
Office Action corresponding to U.S. Appl. No. 10/888,358 dated Mar. 13, 2008.
Notice of Allowance and Interview Summary corresponding to U.S. Appl. No. 10/886,358 dated Nov. 6, 2008.

* cited by examiner

CONNECTOR ASSEMBLY FOR ALLOWING RELATIVE MOVEMENT BETWEEN TWO BUILDING MEMBERS

CROSS REFERENCE TO RELATED APPLICATIONS

This application claims the benefit of and priority to U.S. Provisional Patent Application Ser. No. 62/436,262, filed on Dec. 19, 2016, which is hereby incorporated by reference in its entirety.

TECHNICAL FIELD

The subject matter disclosed herein relates generally to building systems. More particularly, the subject matter disclosed herein relates to systems, assemblies, and methods for connecting structural members together.

BACKGROUND OF THE INVENTION

Seismic activity plagues buildings and their inhabitants in many areas of the world, causing untold amounts of damage and monetary loss in addition to injury and loss of life. Building damage is mainly due to the vibration of a building which causes shifts of one portion of the building frame with respect to another portion. In conventional construction, the building components are rigidly locked together and their connective joints will fracture under the vibrational stress, often resulting in collapse.

It has been recognized that an important need to permit building frame members to shift rather than fracture. However, none of the prior attempts to provide connective building components which permit relative movement between structural members in a vertical direction provides for movement in a horizontal plane, although this movement does occur during an earthquake. Thus, while the building floor is free to move relative to its walls for a limited vertical distance when the known connectors are used, horizontal movement is not an option. When the seismic vibration occurs in a direction to induce horizontal shift, damage, injury, and death can still happen. In addition, horizontal shift of building frame elements can ease construction during the installing of exterior walls of buildings, even if this this allowance for horizontal shift of building frame members is later locked after installation (e.g., if not structurally needed during the service life of the building).

SUMMARY

In accordance with this disclosure, systems, assemblies, and methods for connecting structural members together are provided. In one aspect, connector assembly is provided for connecting first and second building members and permitting relative movement between the first and second building members. The connector assembly includes an elongated track having a web, opposed edge portions that extend from a first surface of the web and that form a pair of slide channels, and one or more protrusions protruding from a second surface of the web opposing the first surface, the one or more protrusions being configured to connect to the first building member. A connecting member is adapted to connect to the second building member and includes a base that retains the connecting member to the channels but is movable within the channels along the track. In this configuration, when the connector assembly is connected between the first and second building members, the connecting member is movable in the track in response to relative movement between the first and second building members.

In another aspect, a building connector assembly is provided for connecting first and second building members together such that one member can move relative to the other. The building connector assembly includes a track comprising one or more protrusions configured for connecting to the first building member and a connecting member configured for connecting to the second building member. The connecting member is movably coupled to the track and movable along the track, and the connecting member includes opposed end portions, a base, and an extension that extends outwardly from the track for connecting to the second building member. The track includes opposed channels, and the connecting member includes a base and an extension, wherein the base is retained in the opposed channels and is permitted to slide back and forth therein. The building connector assembly permits relative movement between the first and second building members by permitting the connecting member to slide along the track.

In yet a further aspect, a method is provided for connecting first and second building members together such that one member can move relative to the other. The method includes positioning a track at or near a concrete form, the track comprising one or more protrusions positioned within the concrete form, pouring concrete into the concrete form to form the first building member, wherein the one or more protrusions are submerged in the concrete, coupling a connecting member to the track, wherein the track includes opposed channels, wherein the connecting member includes a base and an extension, wherein the base is retained in the opposed channels and is permitted to slide back and forth therein, and wherein the connecting member includes an extension that extends outwardly from the track, and connecting the extension of the connecting member to the second building member. In this way, the connecting member is slidable along the track such that the first and second building members are movable relative to one another.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides systems, assemblies, and methods for connecting structural members together. Referring now to the Figures, in one aspect, the present subject matter provides a connector assembly, indicated generally by the numeral 250. Connector assembly 250 is connected between a first building member 233 and a second building member 230. In some embodiments, for example, first building member 233 can be a horizontal member that forms a part of a floor structure, and second building member 230 can be a stud or other vertical member to which the floor structure is to be coupled. As will be appreciated from subsequent portions of this disclosure, when connector assembly 250 is connected between first building member 233 and second building member 230, bidirectional movement is permitted between the first and second building members.

Figure 2:
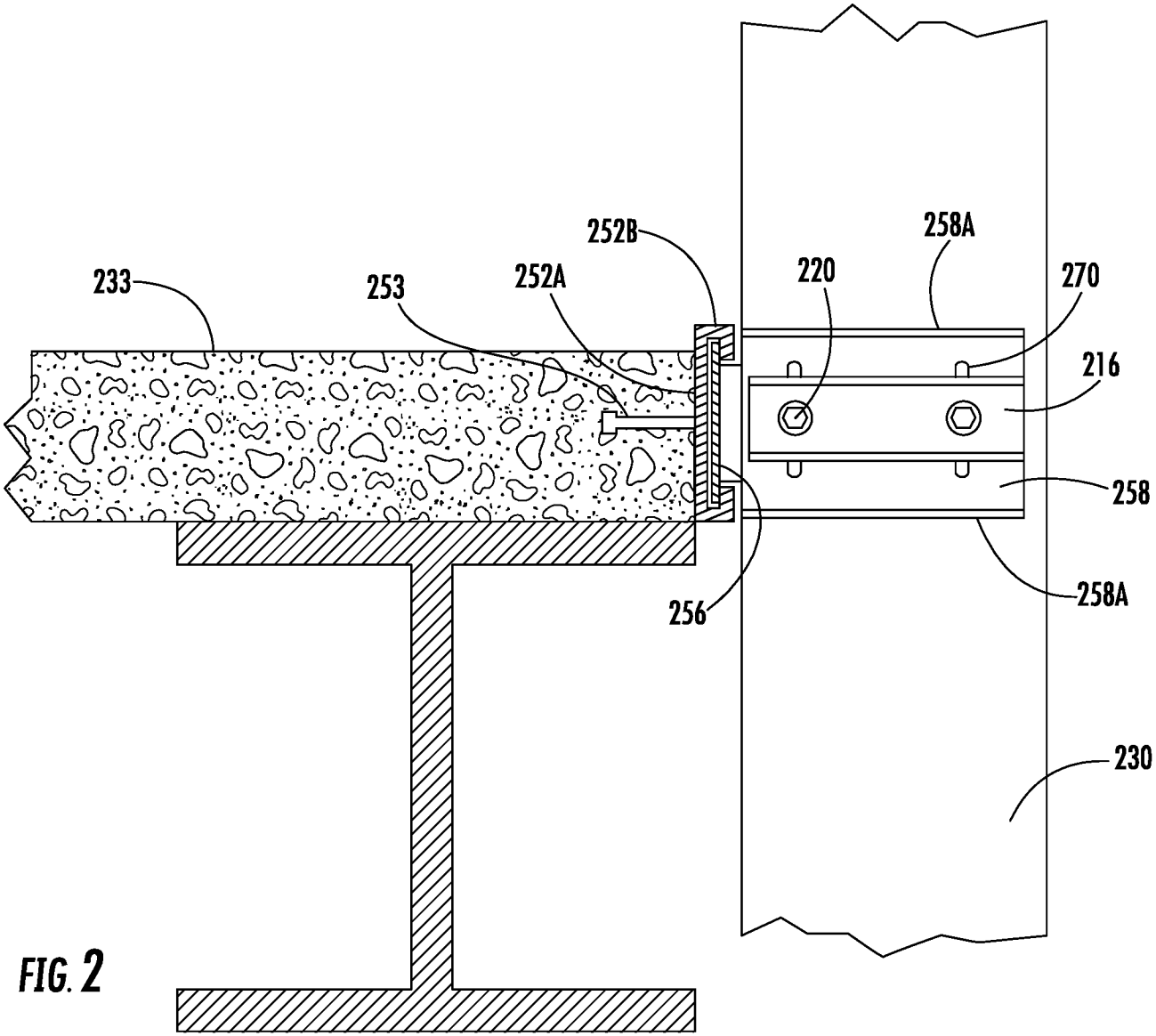
FIG. 2 is a cross sectional view taken through the line 2-2 of FIG. 1.

Continuing with reference to the Figures, including particularly FIG. 2, in the illustrated embodiments, connector assembly 250 includes an elongated track 252 that is secured to first building member 233. In some embodiments, elongated track 252 is generally C-shaped and includes a back or web 252A and opposed outer edge portions 252B that extend a first direction away from web 252A, with outer edge portions 252B forming a channel therebetween. In some embodiments, connector assembly 250 further includes one or more structures configured to be directly integrated into the connecting structure. In particular, for example, as illustrated in FIG. 2, one or more fasteners, studs, or other protrusions 253 are affixed to the back of connector assembly 250 (i.e., extending from the opposing surface of web 252A in a second direction substantially opposed to the first direction) and are configured to be coupled with first building member 233. In some embodiments, for example, first building member 233 comprises a concrete slab, and protrusions 253 can be set in first building member 233.

Figure 3:
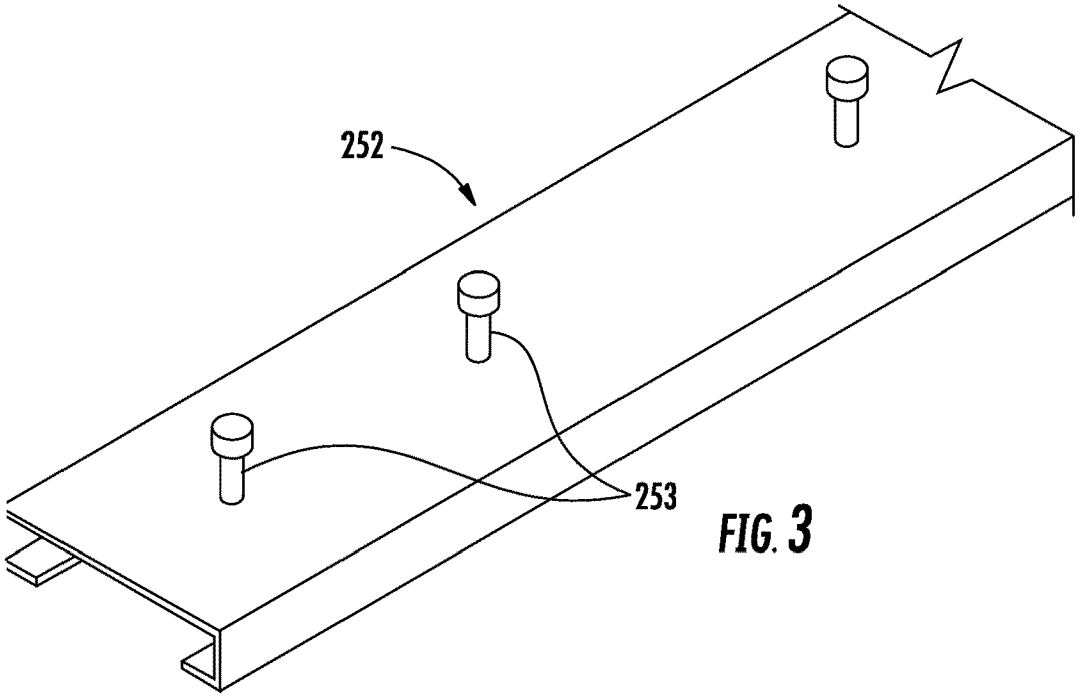
FIG. 3 is a perspective top view of a track element of a connector assembly according to an embodiment of the presently disclosed subject matter.
Figure 4:
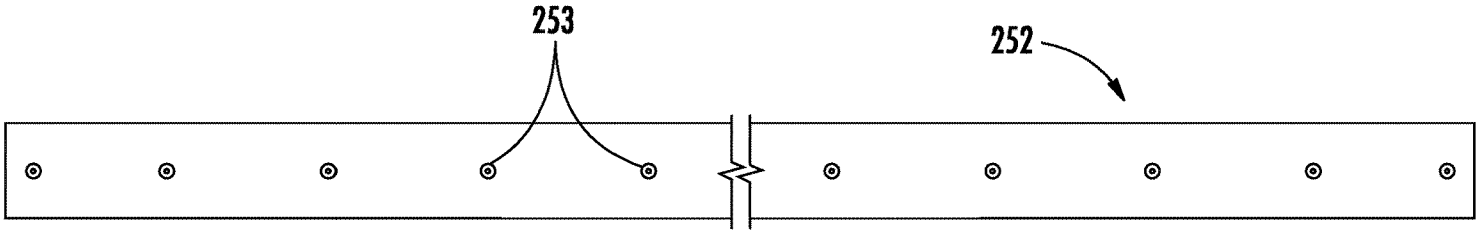
FIG. 4 is a top plan view of a track element of a connector assembly according to an embodiment of the presently disclosed subject matter.
Figure 5A:
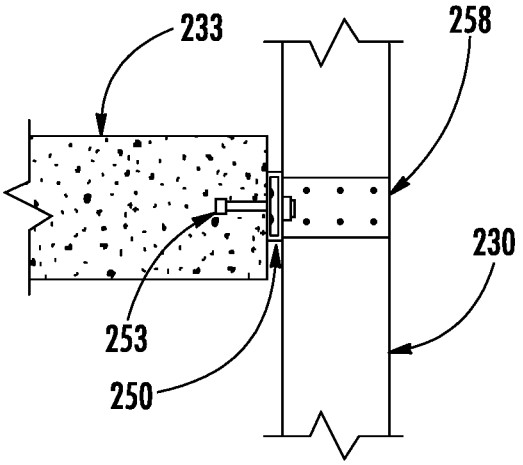
FIGS. 5A through 5F are side cutaway views of a connector assembly connected between first and second building members according to various embodiments of the presently disclosed subject matter.
Figure 5B:
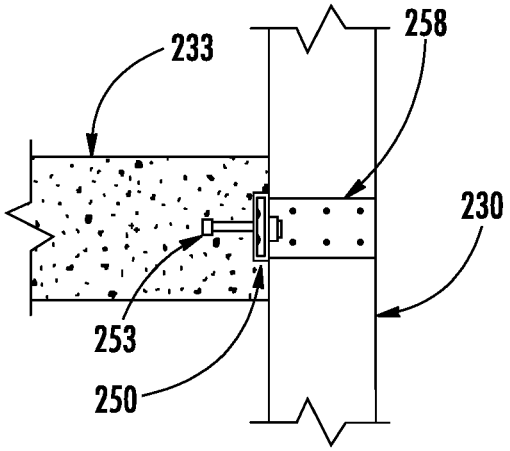
Figure 5C:
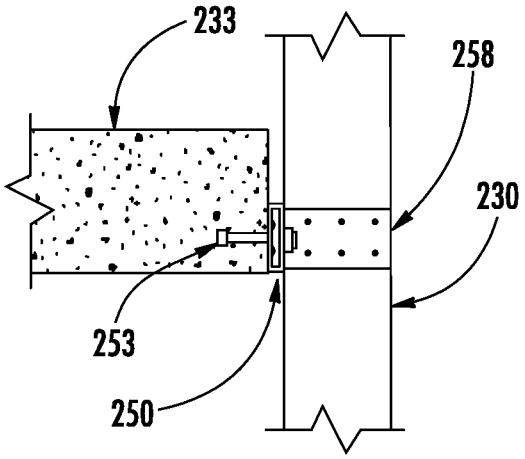
Figure 5D:
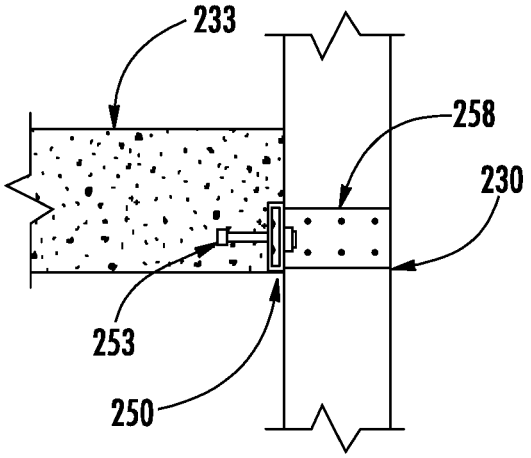
Figure 5E:
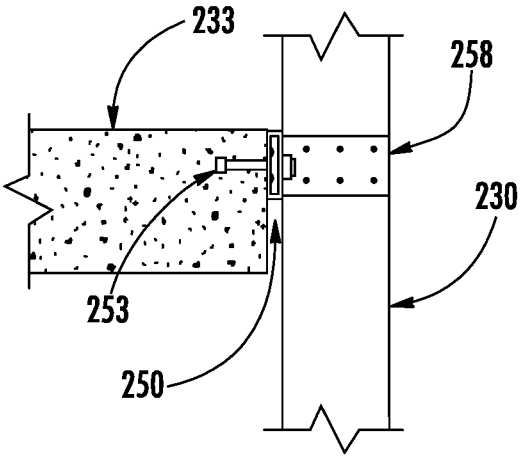
Figure 5F:
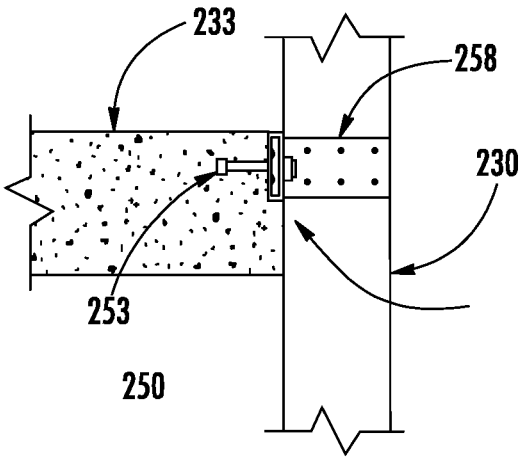
Figure 6:
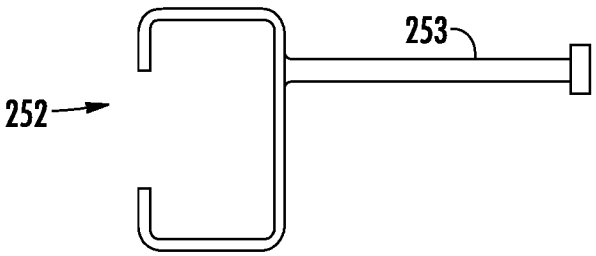
FIG. 6 is a side view of a track element of a connector assembly according to an embodiment of the presently disclosed subject matter.
Figure 7:
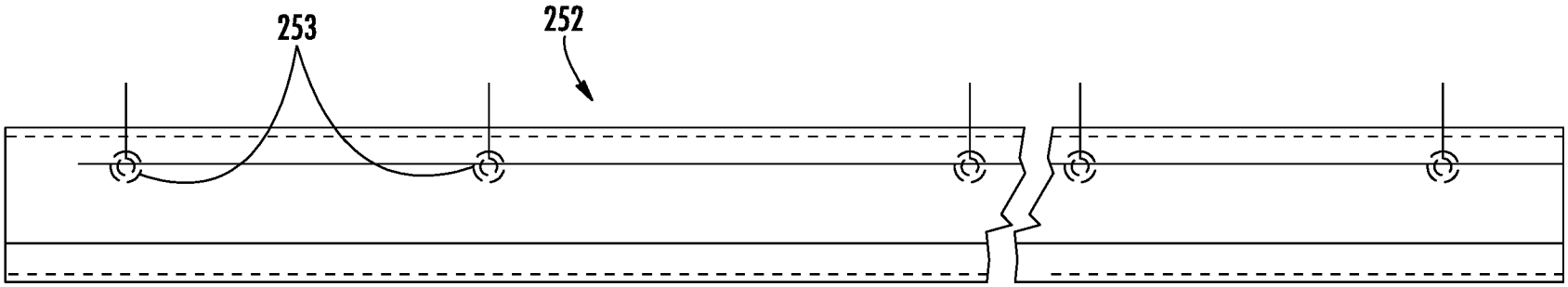
FIG. 7 is a top plan view of a track element of a connector assembly according to an embodiment of the presently disclosed subject matter.
Figure 8:
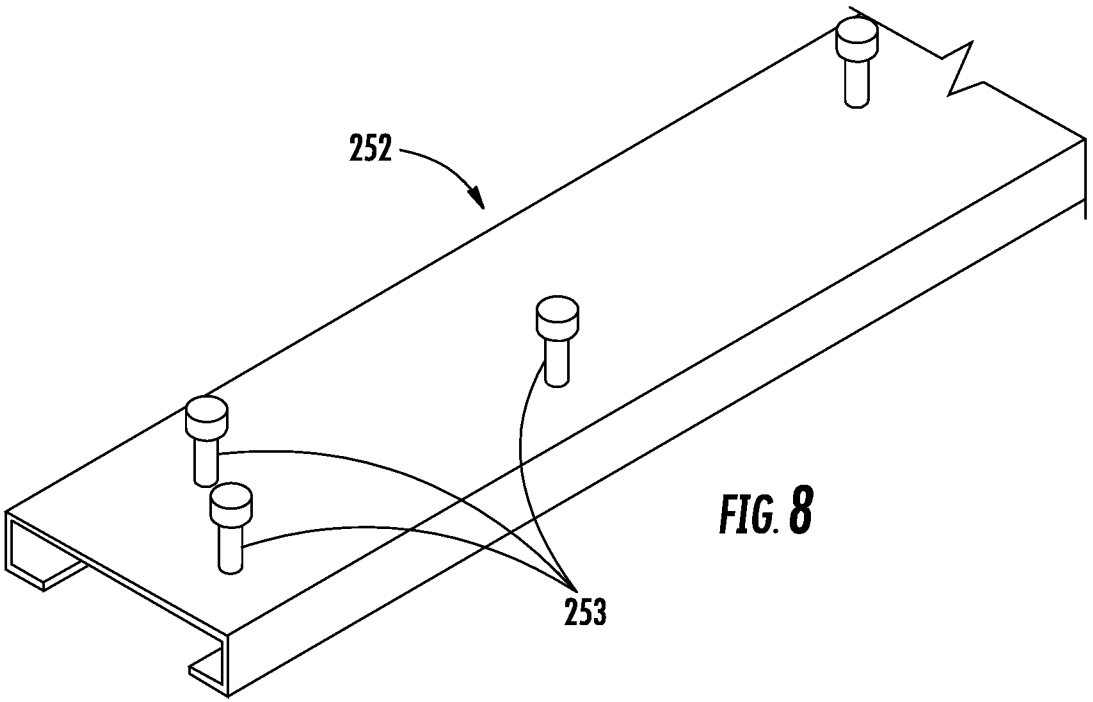
FIG. 8 is a perspective top view of a track element of a connector assembly according to an embodiment of the presently disclosed subject matter.
Figure 9:
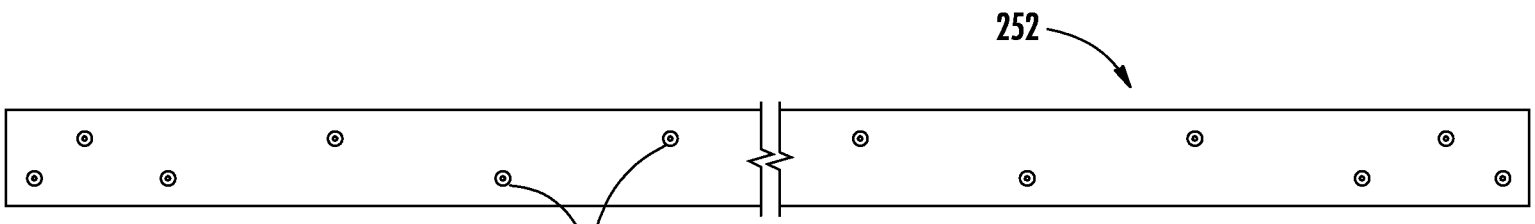
FIG. 9 is a top plan view of a track element of a connector assembly according to an embodiment of the presently disclosed subject matter.
Figure 10A:
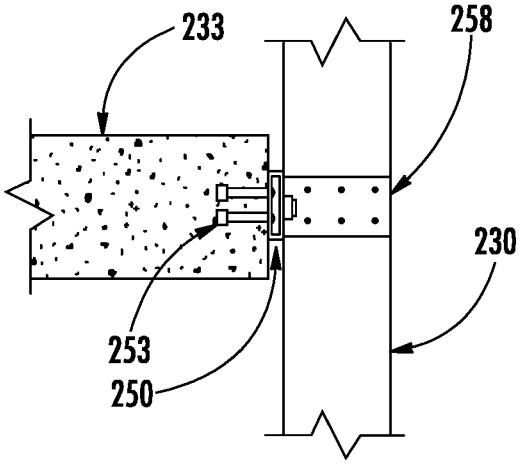
FIGS. 10A through 10F are side cutaway views of a connector assembly connected between first and second building members according to various embodiments of the presently disclosed subject matter.
Figure 10B:
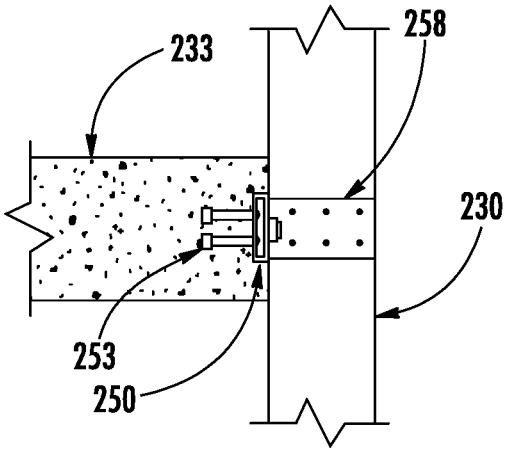
Figure 10C:
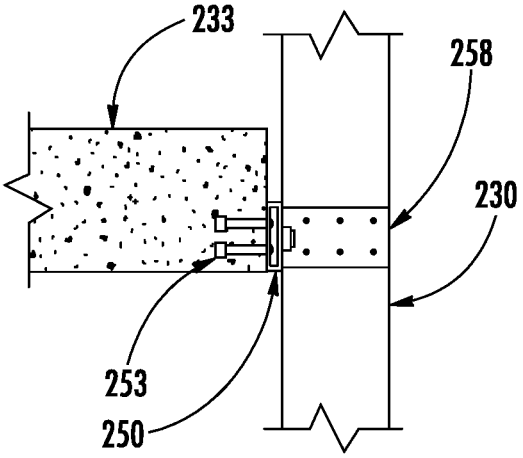
Figure 10D:
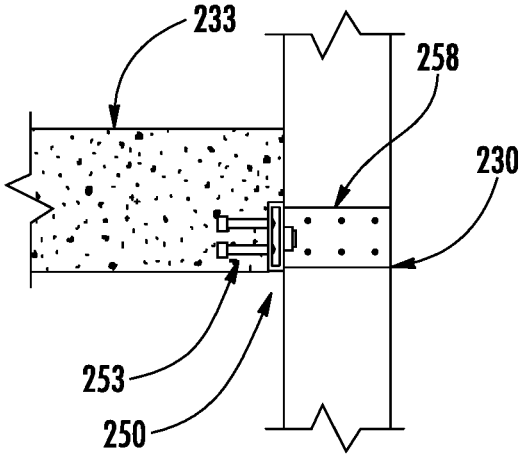
Figure 10E:
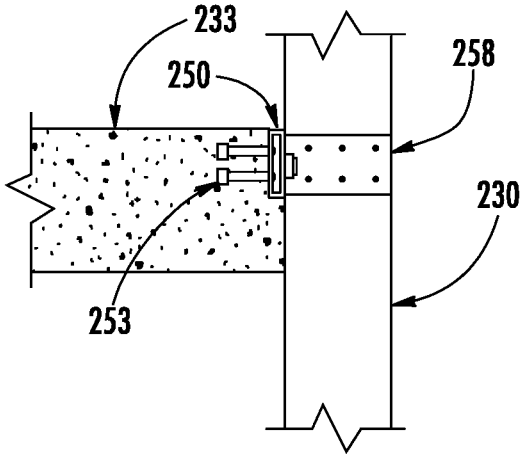
Figure 10F:
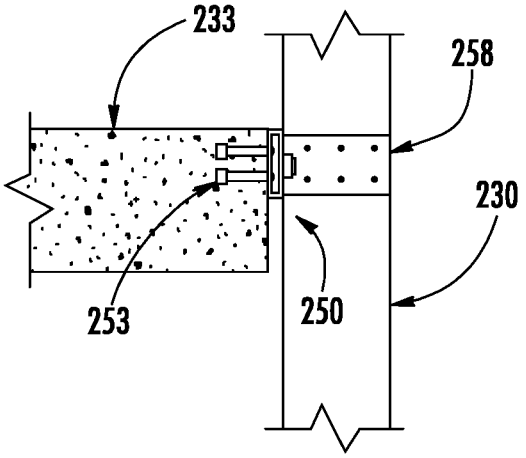

In some embodiments, a stud welding technique is used to affix protrusions 253 to connector assembly 250. These protrusions 253 can be provided in any of a variety of arrangements, such as a plurality of protrusions arranged in one or more linear array along the length of track 252. In the embodiment illustrated in FIGS. 3 and 4, for example, a single row of protrusions is arranged along the length of track 252, with each of protrusions 253 being substantially centered with respect to the width of web 252A of track 252. Alternatively, as illustrated in FIGS. 6 and 7, protrusions 253 can be offset towards one edge of web 252A. In yet a further alternative, FIGS. 8 and 9 illustrate an embodiment in which two rows of protrusions are arranged in a staggered alignment along the length of track 252. Those having ordinary skill in the art will recognize, however, that these embodiments are provided as representative examples, but any of a variety of further arrangements would be apparent to one of ordinary skill in the art upon a review of the instant disclosure. In some embodiments, the particular protrusion pattern can be designed to optimize the load-carrying capacity of the system.

Regardless of the particular arrangement of protrusions 253 or of connector assembly 250 generally, connector assembly 250 can be configured such that track 252 is positioned at or near a concrete form that is used to create first building member 233. In some embodiments, for example, connector assembly 250 is positioned with respect to the concrete mold such that protrusions 253 are inserted into the concrete form. In this arrangement, only protrusions 253 will be imbedded in first building member 233, such as is illustrated in FIGS. 5A, 5C, 5E, 10A, 10C, and 10F. In some alternative embodiments, connector assembly 250 can itself be at least partially inserted into the concrete mold such that at least a portion of connector assembly 250 is imbedded in first building member 233 along with protrusions 253, such as is illustrated in FIGS. 5B, 5D, 5F, 10B, 10D, and 10E. Furthermore, the position of connector assembly 250 with respect to the concrete mold can further be adjusted to change the vertical position of connector assembly with respect to first building member 233 to be in a middle attachment position (See, e.g., FIGS. 5A, 5B, 10A, and 10B), in a bottom attachment position (See, e.g., FIGS. 5C, 5D, 10C and 10D), in a top attachment position (See, e.g., FIGS. 5E, 5F, 10E, and 10F), or in any of a variety of other positions therebetween. For example, in some embodiments, connector assembly 250 can be sized and positioned so that the connection between first building member 233 and second building member 230 does not obstruct any other structure in the structure. Specifically, for example, in configurations where first building member 233 is a post-tensioned concrete slab, the size and position of connector assembly 250 can be designed to fit below the pocket of steel tendons in the post-tensioned concrete slab.

In any arrangement, with connector assembly 250 arranged in a desired position with respect to the concrete mold, concrete can then be poured into the mold and over the protrusions to produce first building member 233. Once the concrete cures, the protrusions thereby become imbedded in first building member 233 such that the connector assembly is secured along the slab edge. This arrangement can thus eliminate the need for screwing, adhering, or otherwise coupling connector assembly to the slab after it has been formed. In some embodiments in which the building comprises a pour on a metal deck, a pour stop can be incorporated into connector assembly 250. A barrier element (e.g., mineral wool) can be provided (e.g., taped) over the inside of track 252, wherein connector assembly can be installed along the pour stop when pouring the slab while preventing concrete from seeping into track 252.

In any configuration, such implementations of connector assembly 250 can save on man lifts, scaffolding, and/or other associated labor and resource costs to install the exterior walls of buildings. This configuration further makes the prefabrication/panelization of building exteriors extremely efficient and reduces cost substantially.

Figure 1:
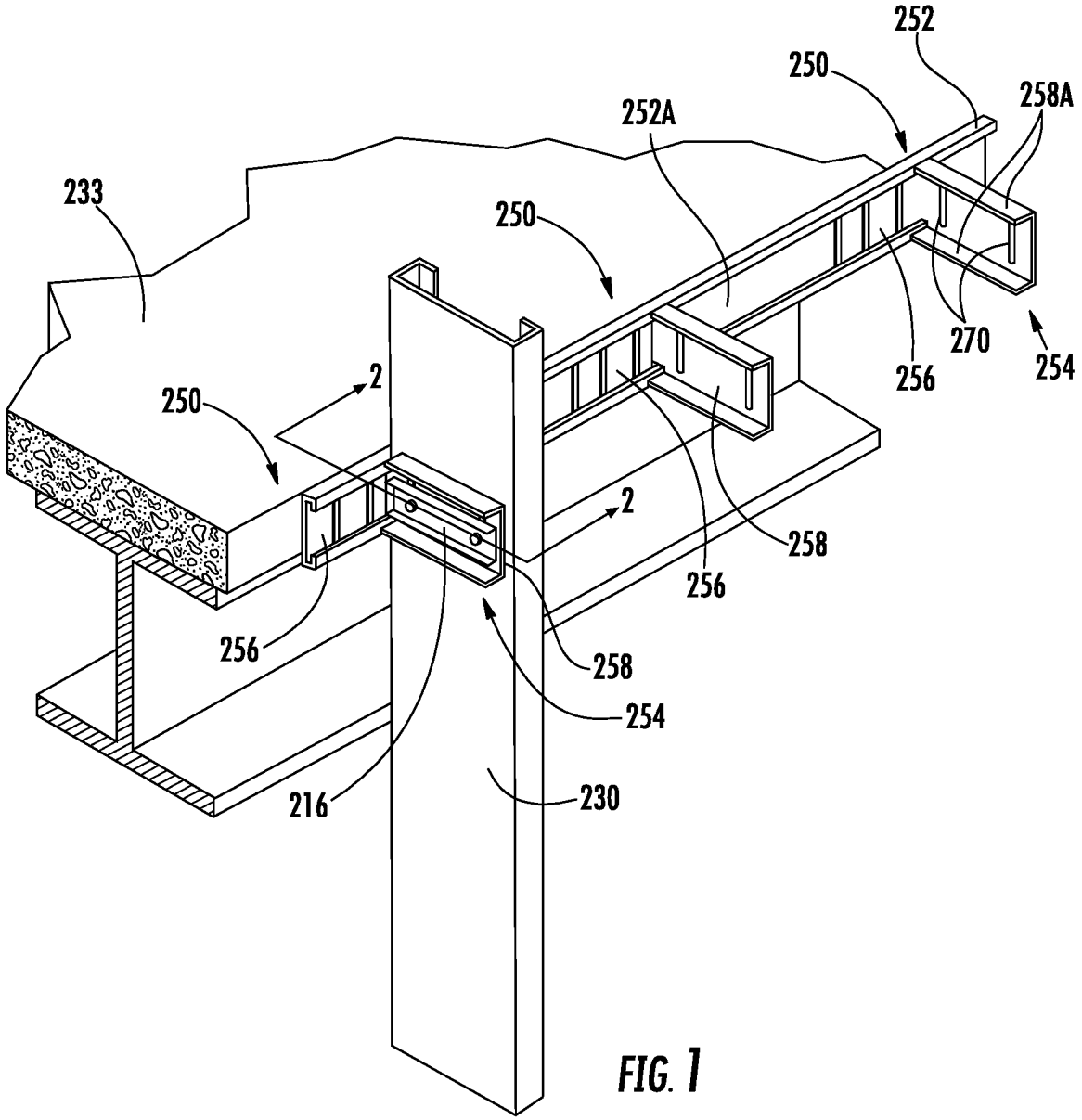
FIG. 1 is a perspective side view of a connector assembly connected between first and second building members according to an embodiment of the presently disclosed subject matter.

Referring now to the connection of connector assembly 250 to second building member 230, in some embodiments, a connecting member, generally designated 254, is slidably mounted or contained within track 252. In some embodiments, connecting member 254 includes a first portion or base 256 and a second portion or extension 258. Base 256 is contained within the elongated track 252 and is slidable laterally therein. That is, as illustrated in FIGS. 1 and 2, base 256 of connecting member 254 is disposed such that it lies adjacent to web 252A of track 252, and outer edge portions 2526 of the track curl around and confine base 256 within the elongated track. It this arrangement, connecting member 254 can slide back and forth within the track. In some embodiments, however, a further locking element (described in more detail below) is provided once horizontal shifting is no longer desired (e.g., after installing of the exterior walls of the building is complete).

Extension 258 of connecting member 254 extends outwardly from track 252. This is illustrated in FIGS. 1, 2, 11A, and 11B. That is, extension 258 is oriented at an angle with respect to base 256. In some embodiments, extension 258 is disposed generally at an angle of approximately 90° with respect to base 256. In some embodiments, base 256 can be provided with a series of ribs that reinforce the same. Extension 258 includes a pair of flanges 258A. In some embodiments, flanges 258A are turned to form a 90° angle with the central area of extension 258.

Figure 11A:
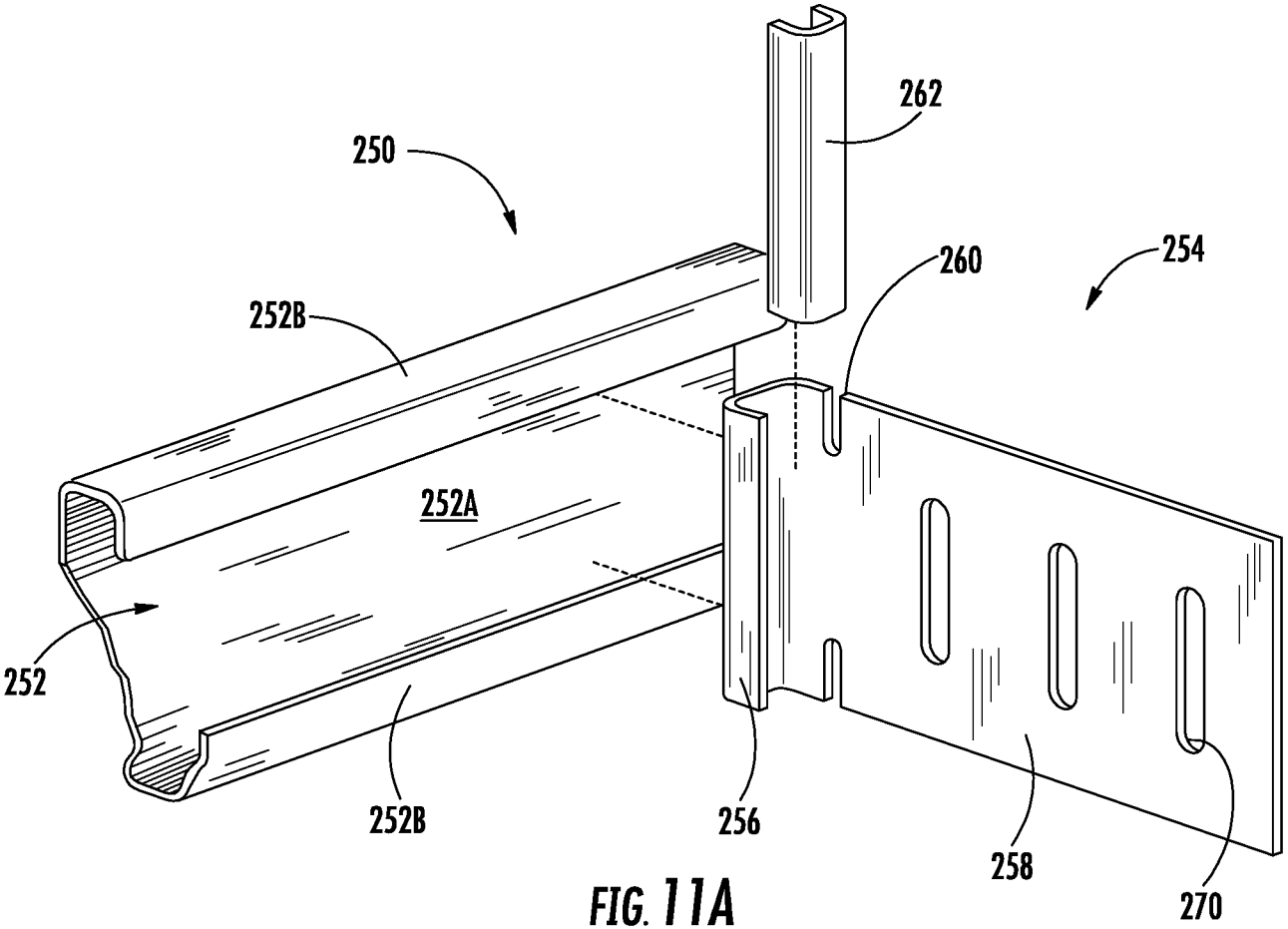
FIGS. 11A and 11B are perspective exploded views of a connector assembly according to embodiments of the presently disclosed subject matter.

In some embodiments, such as is illustrated in FIG. 11A, a series of elongated slots 270 are formed in extension 258. Various fasteners can be utilized to secure the extension 258 to second building member 230 shown in FIGS. 1 and 2. For example, fasteners and stepped washers as discussed and disclosed in the U.S. Pat. No. 7,104,024, which is incorporated herein by reference, can be used. Such an arrangement permits extension 258 to slide with respect to second building member 230 even while the fasteners would retain the extension to the second building member. In the embodiment illustrated in FIGS. 1 and 2, a reinforcing member 216 is disposed adjacent to extension 258 (e.g., connected by fasteners 220) when the extension is coupled or secured to second building member 230.

Figure 11B:
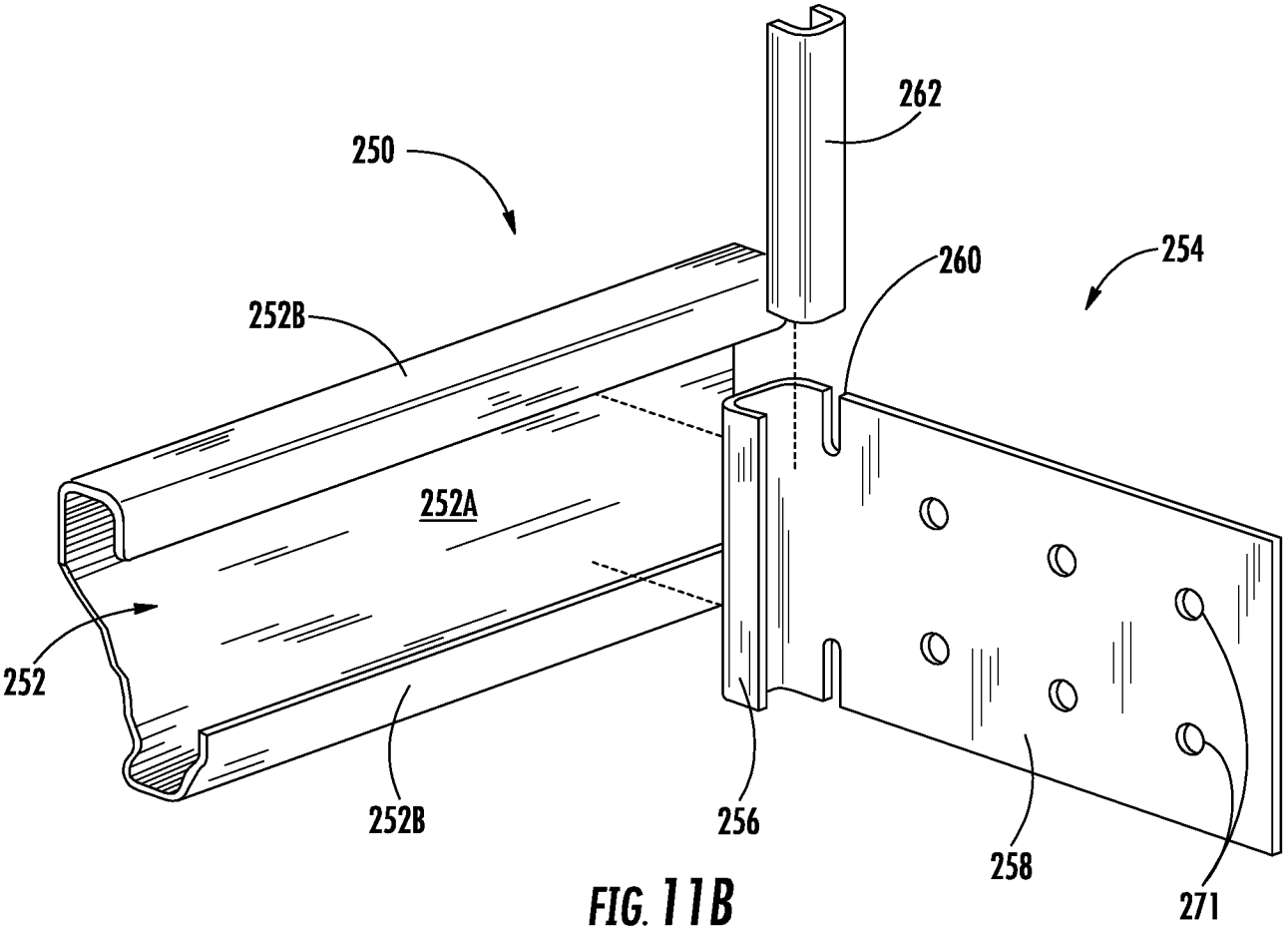

Alternatively, in some other embodiments, such as is illustrated in FIG. 11B, the connection of extension 258 to second building member 230 can be less adjustable. As illustrated in FIG. 11B, for example, rather than elongated slots 270 being configured to receive fasteners for securing to second building member 230, a plurality of openings 271 can instead be configured to each receive a fastener therethrough for installation to second building member 230. Those having ordinary skill in the art will recognize that either configuration for extension 258 can be combined with any of the embodiments for track 252 discussed above such that any of a wide variety of combinations of building elements can be used based on the particular needs of the building project.

In some embodiments, base 256 and extension 258 of connecting member 254 are of an integral construction (e.g., formed from a single piece of metal). An example of the construction of connecting member 254 would entail cutting opposed slots from opposite edges of connecting member 254 about a bend or juncture area. Thereafter, connecting member 254 would be bent such that a selected angle is formed between base 256 and extension 258. Thereafter, flanges 258A would be formed by simply bending them to the position that they occupy in FIGS. 1 and 2. Of course, it is appreciated that other procedures can be followed to form or fabricate connecting member 254. That is, and in the way of an example, connecting member 254 could comprise a multi piece member.

As illustrated in FIG. 1, track 252 can accommodate a series of spaced apart connecting members 254. Connecting members 254 would be spaced such that they can move back and forth within track 252. Consequently, it is appreciated that the entire connecting member 254 can move back and forth within elongated track 252 in response to certain loads or forces being applied to the building structure. In addition, in some embodiments, there could be relative movement between extension 258 of connecting member 254 and second building member 230.

Figure 12:
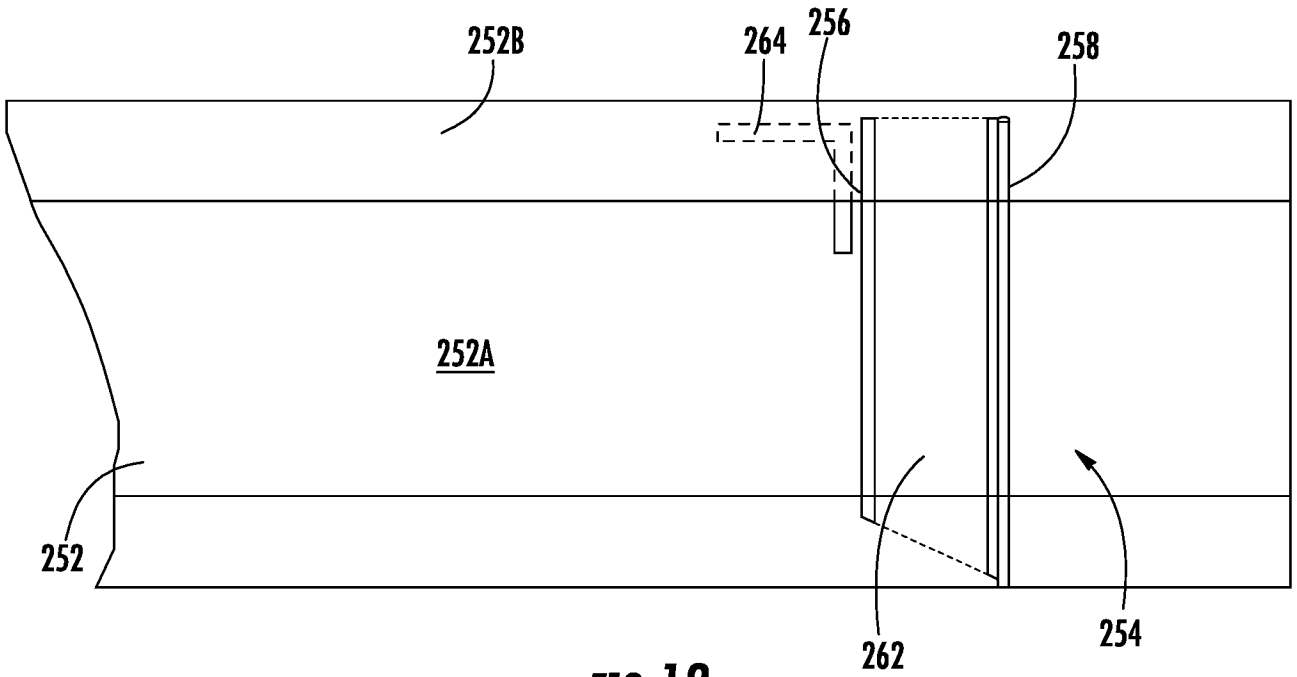
FIG. 12 is a side elevational view of the connector assembly of FIG. 11A.

That being said, in some embodiments, once horizontal shifting is no longer desired (e.g., after installing of the exterior walls of the building is complete), connector assembly 250 can further include a locking element that prevents further horizontal movement between first building member 233 and second building member 230. For example, as illustrated in FIG. 12, a slide lock 264 can be coupled to both of track 252 and connection member 254 (e.g., by one or more fastener) to prevent relative motion between these elements.

In some embodiments, base 256 includes a reinforcing member 262 that is configured to reinforce connecting member 254. In some embodiments, reinforcing member 262 is a piece of channel-shaped (e.g., substantially U-shaped) metal. Reinforcing member 262 can be of a square or rectangular channel or could, as illustrated in the drawings herein, be of a slightly rounded channel shape. In any configuration, reinforcing member 262 can be inserted and secured within connecting member 254. Various fasteners can be utilized to secure reinforcing member 262. In some embodiments, reinforcing member 262 is taped into base 256.

As discussed above, in some embodiments, extension 258 includes a series of elongated slots 270 that are configured to connect extension 258 to second building member 230. Even when connected, however, elongated slots 270 permit relative movement between extension 258 and second building member 230. In some embodiments, elongated slots 270 extend generally perpendicular with respect to track 252, such as is illustrated in FIGS. 1, 2, and 11A.

In some embodiments, connecting member 254 includes a pair of notches 260 (see, e.g., FIG. 11A), which are provided to accommodate a portion of the channels defined by edge portions 252B of track 252. That is, when connecting member 254 is retained within track 252, the back flanges of these channels extend through a portion of notches 260. In addition, in installing connecting member 254, the connecting member will be rotated into a position in which base 256 extends generally perpendicular to the length or longitudinal axis of track 252. During this rotation, notches 260 will be rotated into and along the back flanges of each of the channels of track 252.

Figure 13:
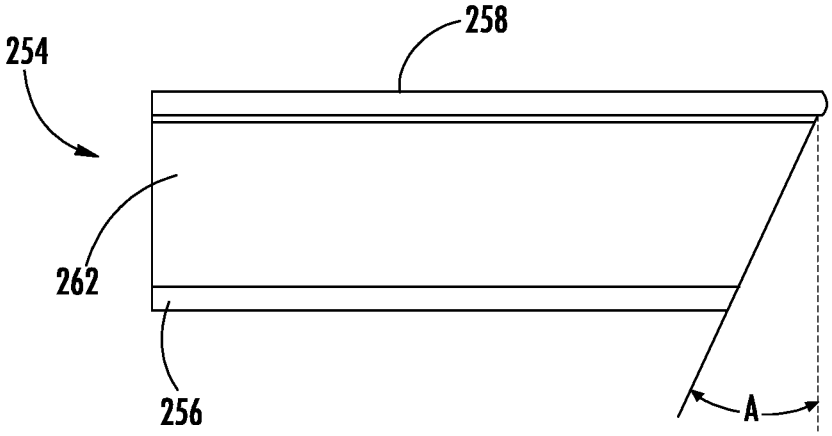
FIG. 13 is a view of a connecting member having an angled portion of the base of the connecting member according to an embodiment of the presently disclosed subject matter.

To help enable this installation, in some embodiments, a portion of base 256 is formed or cut at an angle to facilitate retaining connecting member 254 to track 252. As illustrated in FIGS. 12 and 13, for example, base 256 includes opposed end portions, with one of these end portions being cut at an angle, generally designated A. It is to be appreciated that if reinforcing member 262 forms a part of base 254, that it too would be cut or formed at this angle.

Figure 14:
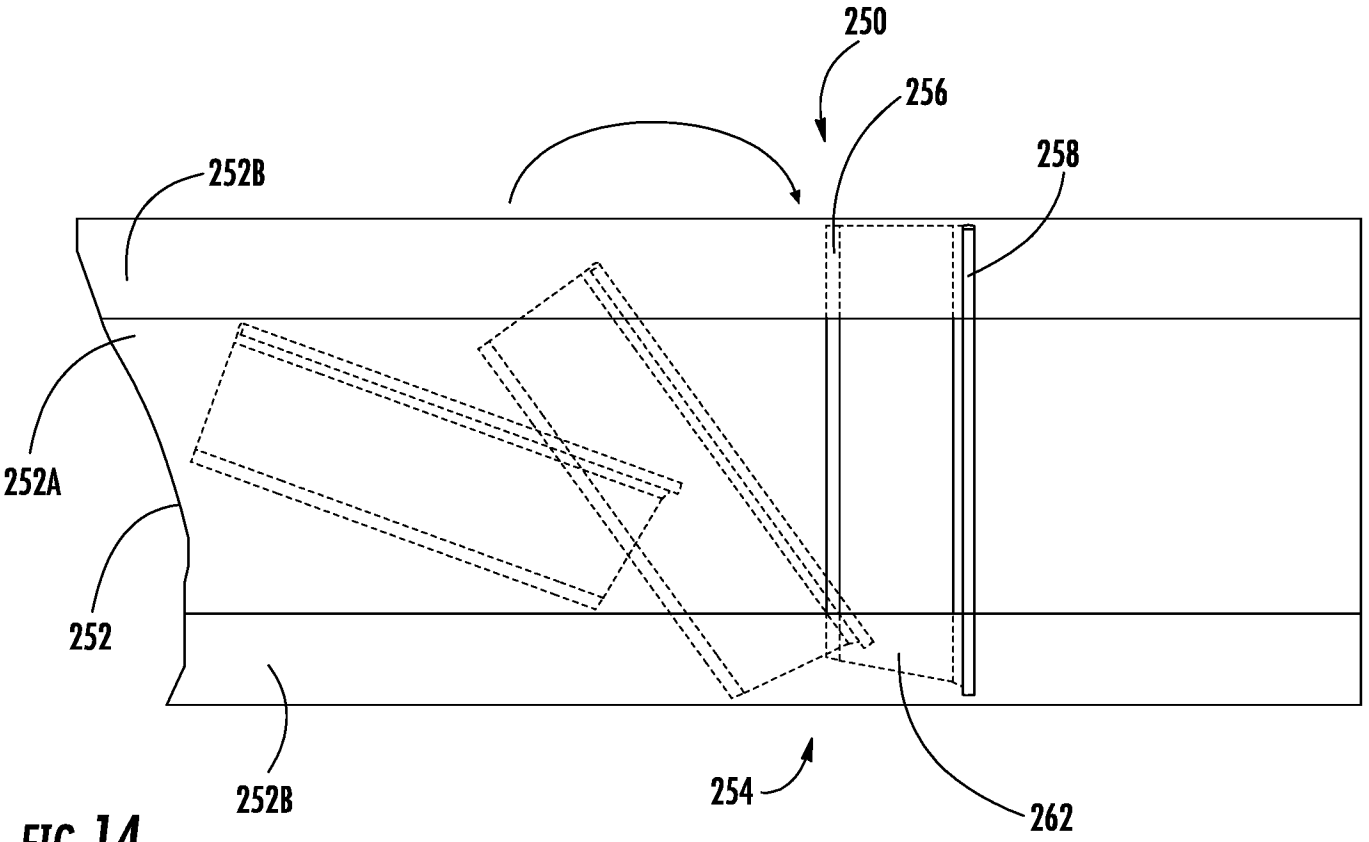
FIG. 14 is a side elevational view showing installation of a connector assembly into position in a track according to an embodiment of the presently disclosed subject matter.

FIG. 14 illustrates an example process by which connecting member 254 of this embodiment can be installed in track 252. Connecting member 254 can be placed in track 252 such that the entire structure of connecting member 254 lies between the opposing outer edge portions 252B. When in this initial position, the end portion of the base 256 that includes the formed or cut angle A lies at about the four o'clock position. To install connecting member 254, the same is rotated clockwise as viewed in FIG. 14. In this arrangement, the angle end portion of the base 256 can be referred to as the leading end portion. As the leading end portion is rotated, it is appreciated that the angled end portion of base 256 will permit the base 256 or lower portion of connecting member 254 to clear the side flanges of outer edge portions 252B. During this rotation, it is appreciated that portions of the back flanges of outer edge portions 252B will pass through notches 260. In any event, connecting member 254 can be rotated clockwise as viewed in FIG. 14 until the connecting member 254 reaches approximately the position shown in full lines in FIG. 14.

Connecting member 254 and particularly the area thereof about base 256 is dimensioned or configured such that, when the connecting member is rotated into the position shown in full lines in FIG. 14, portions of connecting member 254 will come into contact with track 252 and particularly portions of the channels defined by outer edge portions 252B such that continued clockwise rotation, as viewed in FIG. 14, cannot be achieved. That is, connecting member 256 is not permitted to be completely rotated in one direction into, through and out of the channels defined by outer edge portions 252B. It follows then, to remove connecting member 254 from within track 252, connecting member 254 can be rotated counterclockwise as viewed in FIG. 14, until the structure of connecting member 254 clears the channels. Once the structure clears the channels, it follows that the entire connecting member 254 can be removed.

Alternatively or in addition, regardless of the particular arrangement of connecting member 254, once it is coupled with track 252, connecting member 254 can be coupled to an associated second building member 230, which can help to prevent rotation of connection member 254 that would unseat connection member 254 from its orientation between outer edge portions 252B. Connecting member 254 can, however, be free to slide within the channel formed between edge portions 252B to accommodate any horizontal shift between the building members as discussed above. Again, however, in some embodiments, connector assembly 250 can further include a locking element that prevents further horizontal movement between first building member 233 and second building member 230.

U.S. Pat. No. 7,503,150 is hereby incorporated herein by reference in its entirety.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A connector assembly comprising:

a first building member comprising a concrete slab;

a second building member;

an elongated track having a web, opposed edge portions that extend in a first direction from a first surface of the web and that form a pair of slide channels, and one or more protrusions affixed to a second surface of the web opposing the first surface, each of the one or more protrusions being offset from a center of the web towards one edge of the web, the one or more protrusions extending in a second direction opposing the first direction, and the one or more protrusions protruding from the second surface and embedded into the concrete slab such that the elongated track is secured along a slab edge of the concrete slab;

a connecting member connected to the second building member and including a base that retains the connecting member to the channels but is movable within the channels along the track;

wherein, when the connector assembly is connected between the first and second building members, the connecting member is movable in the track in response to relative movement between the first and second building members.

2. The connector assembly of claim 1, wherein the one or more protrusions comprises a plurality of protrusions arranged in one or more linear arrays along a length of the track.

3. The connector assembly of claim 1, wherein the one or more protrusions are welded to the track.

4. The connector assembly of claim 1, wherein the connector assembly forms a part of a building frame structure wherein the first and second building members comprise at least one vertical member and one horizontal member.

5. The connector assembly of claim 4, wherein the track is adapted to connect to the horizontal member.

6. The connector assembly of claim 1, wherein the one or more protrusions each comprise:

a stud having an elongated shaft extending away from the second surface of the web; and a head fixed to a distal end of the shaft, the head having a diameter that is larger than a diameter of the shaft.

7. A building connector assembly comprising:

a first building member comprising a concrete slab;

a second building member;

a track comprising one or more protrusions affixed to a surface of the track, each of the one or more protrusions being offset from a center of the surface towards one edge of the surface, the one or more protrusions embedded into to the concrete slab such that the track is secured against a slab edge of the concrete slab; and a connecting member connected to the second building member;

wherein the connecting member is movably coupled to the track and movable along the track;

wherein the connecting member includes opposed end portions, a base, and an extension that extends outwardly from the track for connecting to the second building member;

wherein the track includes opposed channels that extend from the surface of the track in a first direction, and wherein the base of the connecting member is retained in the opposed channels and is permitted to slide back and forth therein;

wherein the one or more protrusions extend from the surface of the track in a second direction opposing the first direction; and wherein the building connector assembly permits relative movement between the first and second building members by permitting the connecting member to slide along the track.

8. The connector assembly of claim 7, wherein the one or more protrusions comprises a plurality of protrusions arranged in one or more linear array along a length of the track.

9. The connector assembly of claim 7, wherein one or more protrusions are welded to the track.

10. The connector assembly of claim 7, wherein the connector assembly forms a part of a building frame structure wherein the first and second building members comprise at least one vertical member and one horizontal member.

11. The connector assembly of claim 10, wherein the track is adapted to connect to the horizontal member.

12. The building connector assembly of claim 7, wherein the one or more protrusions each comprise:

a stud having an elongated shaft extending away from the surface of the track; and a head fixed to a distal end of the shaft, the head having a diameter that is larger than a diameter of the shaft.

* * * * *